United States Patent [19]

Heyke

[11] Patent Number: 4,556,040

[45] Date of Patent: Dec. 3, 1985

[54] DISTRIBUTORLESS IGNITION SYSTEM FOR MULTI-CYLINDER INTERNAL COMBUSTION ENGINE WITH MISFIRE SUPPRESSION

[75] Inventor: Klaus Heyke, Reutlingen, Fed. Rep. of Germany

[73] Assignee: Robert Bosch GmbH, Stuttgart, Fed. Rep. of Germany

[21] Appl. No.: 693,259

[22] Filed: Jan. 22, 1985

[30] Foreign Application Priority Data

Mar. 30, 1984 [DE] Fed. Rep. of Germany ..... 3411845

[51] Int. Cl.[4] ..... F02P 1/00

[52] U.S. Cl. ..... 123/643; 123/655; 123/656

[58] Field of Search ..... 123/643, 655, 656, 630

[56] References Cited

U.S. PATENT DOCUMENTS

| | | | |
|---|---|---|---|
| 3,910,247 | 10/1975 | Hartig | 123/656 X |
| 4,103,659 | 8/1978 | Donigian | 123/655 |
| 4,203,403 | 5/1980 | Fujii et al. | 123/655 X |
| 4,411,247 | 10/1983 | Kunita et al. | 123/655 |
| 4,463,744 | 8/1984 | Tanaka et al. | 123/655 X |

*Primary Examiner*—Tony M. Argenbright

*Attorney, Agent, or Firm*—Frishauf, Holtz, Goodman & Woodward

[57] ABSTRACT

To prevent malfunction due to misfire of a distributorless internal combustion engine (ICE), in which two spark plugs (20, 21; 27, 28) are connected to the same output terminals of the secondary (9) of an ignition coil through respectively reversely polarized diodes (18, 19; 25, 26), the polarity of the output spark pulse at the terminals (17, 24) of the ignition coil determining the identity of the spark plugs which have spark discharges occur thereacross due to the polarization of the serially connected diodes, additional diodes (22, 23; 29, 30) of the high-voltage type are connected in parallel across each of the spark plugs (20, 21; 27, 28) and polarized in reverse polarity with respect to the serially connected diodes, connected to the respective spark plugs, to thereby short-circuit current through the additional diode upon passage of energy by a serially connected diode in reverse direction due to malfunctioning, for example alloying-through or at least partial short-circuiting of the respective serially connected diode.

2 Claims, 1 Drawing Figure

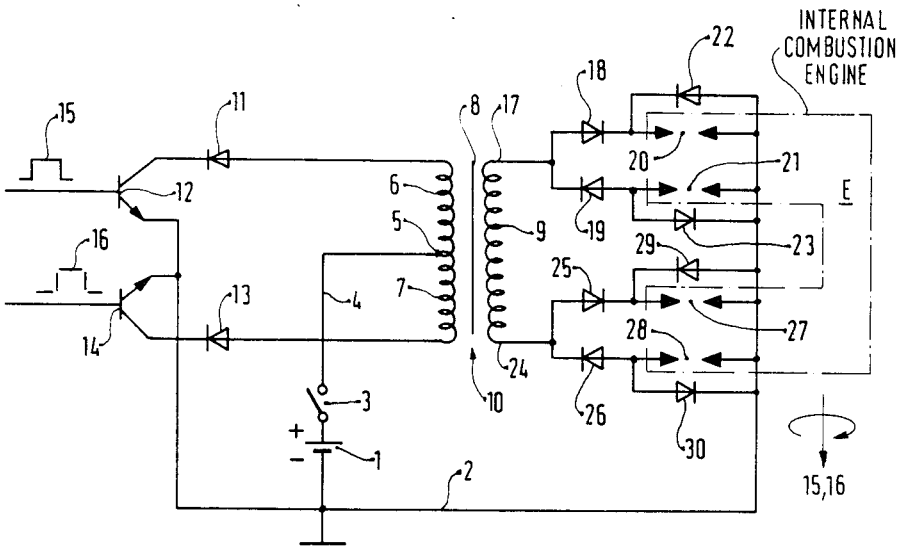
INTERNAL
COMBUSTION
ENGINE
15
16
11
12
13
14
8
17
6
5
7
9
4
3
1
2
10
18
19
20
21
22
23
24
25
26
27
28
29
30
E
15,16

DISTRIBUTORLESS IGNITION SYSTEM FOR MULTI-CYLINDER INTERNAL COMBUSTION ENGINE WITH MISFIRE SUPPRESSION

The present invention relates to an ignition system for multi-cylinder internal combustion engines without using a distributor to distribute spark energy to spark plugs associated with the respective cylinders, and more particularly to such a system in which for any ignition event, two spark plugs associated with two different cylinders are simultaneously energized, one of the spark plugs firing at the appropriate ignition instant, and the other spark plug firing during the exhaust stroke of the engine, so that its spark will not have any combustion effect in the engine except, possibly, to ignite previously unburned residual gases which might be present in the exhaust.

BACKGROUND

It has previously been proposed to provide an ignition coil whose terminal ends are connected to two parallel connected spark plugs through reversely polarized diodes so that, upon selective energization of the primary of the ignition coil in different directions of current flow, selected spark plug pairs fire simultaneously, the identity of the spark plug pair firing being determined by the polarization of the respective diodes. It has been found that damage to the diodes, for example alloying-through or effective short-circuit or low-resistance paths through one of the diodes may cause firing of the spark plugs at undesired instants, for example during the intake or compression stroke of the engine, resulting in misfires and possible damage to the internal combustion engine (ICE) in which the ignition system is installed.

THE INVENTION

It is an object to improve a spark plug system of the kind referred to by so arranging the system that misfires are effectively prevented.

Briefly, misfires of the engine are prevented by suppression of undesired firing of spark discharge of a spark plug upon malfunction of a respective serially connected diode when ignition energy is passed to the serially connected diodes which may be malfunctioning, by providing an additional diode connected in parallel across each of the spark plugs and polarized in reverse polarity with respect to the serially connected diodes. The parallel connected diodes then will act as a short circuit of much lower resistance than the spark path of the spark plug and shunt or short-circuit electrical energy through the spark plug, so that, even though the serially connected diode may not have blocked electrical energy, energy will not appear across the spark gaps and thereby prevent misfire of the engine by short-circuiting sparking energy which would be applied to the respective spark plug at the wrong time.

The system has the advantage that by the simple expedient of adding a diode in parallel to the spark gap of the spark plugs, when properly polarized, misfires of the engine, and thus possible damage thereto, is effectively avoided.

DRAWING

The single FIGURE is a schematic diagram of the ignition system incorporating the present invention.

DETAILED DESCRIPTION

An internal combustion engine (ICE), shown schematically only by the block E, has an output shaft which rotates at a speed n. The ignition system for the ICE is supplied with energy from a direct current source 1 which, typically, is the battery of an automotive vehicle. The system is shown to operate with a "negative ground", the ground terminal being represented by the chassis of the vehicle, or the chassis bus 2. The positive terminal of the battery is connected through a main or ignition switch 3 which supplies an ignition power bus 4. The power bus 4 is connected to the center tap 5 of a primary winding having primary winding portions 6, 7 of an ignition coil 10. The primary winding portions 6, 7 are wound on an iron core 8 and, together with the core 8 and a secondary winding 9, form the ignition coil 10. The free terminals of the primary winding 6 are connected, each to the anode of respective blocking diodes 11, 13, the cathodes of which are connected to the collectors of transistors 12, 14. The emitters of the transistors 12, 14 are connected to the ground or chassis bus 2. The bases of the transistors 12 and 14 are supplied with connection pulses 15, 16, respectively, in synchronism with rotation of the engine as schematically shown by the arrow n in accordance with any suitable and well known and conventional ignition system.

The free terminal 17 of secondary 9 is connected to the anode of a diode 18 and the cathode of a diode 19. The cathode of diode 18 is connected to spark plug 20. The anode of diode 19 is connected to a spark plug 21. The second terminal of the spark plug is connected to ground or chassis, as well known in automotive technology. The second free terminal 24 of the secondary winding 9 is connected to the anode of a diode 25 and to the cathode of a diode 26. The cathode of diode 25 is connected to spark plug 27, and the anode of diode 26 is connected to spark plug 28. Spark plugs 27, 28 have the other terminal of their spark gap connected to ground or chassis, as well known.

The system described so far is known in the prior art and described, for example, in the referenced German Pat. No. 23 39 784.

BASIC OPERATION

The system is ready to operate upon closing of main or ignition switch 3. Let it be assumed that the pulse 15 is effective. The primary winding 6 will then be switched by the transistor 12. Upon switching-off of the transistor 12, the secondary winding 9 of the ignition coil will have a high-voltage pulse induced therein due to sudden interruption of current flow through the primary winding 6. The voltage pulse will be so polarized that the terminal 17 will be positive and the terminal 24 negative. Consequently, the diodes 18, 26 will be conductive, and spark plugs 20, 28 will have a spark flashover occur thereat. The spark plugs 21, 27, however, will not have a spark appear thereacross since the diodes 19, 26 block application of ignition energy due to their polarization counter the polarity of the ignition pulse at the secondary 9 of the ignition coil.

Upon subsequent occurrence of the ignition pulse 16, the primary winding 7 will be switched ON and OFF by the transistor 14, so that the secondary winding 9 will have a high-voltage pulse appear thereat in which the terminal 24 is positive and the terminal 17 is negative. This, then, causes spark plugs 21, 27 to have flashover sparks appear thereat, the spark plugs 20, 28 not having a spark occur due to the blockage effect of the diodes 18, 26.

It has been found that, if one or more of the diodes 18, 19, 25, 26 are defective, for example alloyed-through, a spark might also occur across a plug where it was not intended; for example, if the ignition pulse is controlled in accordance with pulse 16, see the FIGURE resulting in desired sparks at spark plugs 21, 27, and diode 18 is defective, an additional spark may also occur at diode 20. This may be due to the fact that the diode 20 is no longer capable of blocking the reverse-polarity high-voltage pulse. In a four-cylinder engine, this spark might occur upon the intake stroke of the cylinder associated with spark plug 20, which might lead to a misfire, and an explosion, which may damage the ICE.

In accordance with the present invention, and in order to prevent such misfires and possible damage to the engine, additional diodes 22, 23, 29, 30 are provided, connected across the spark gaps of the spark plugs 20, 21, 27, 28 and polarized in a direction opposite to that of the serially connected diodes 18, 19, 25, 26 associated with the respective spark plugs. By this simple expedient, electrical energy which is applied to one of the spark plugs with a polarity counter that with which the spark plug is to operate normally, is bypassed or short-circuited through the low-resistance path of the respective parallel connected diode, thus suppressing occurrence of a spark at the respective spark plug protected by the parallel connected diode. The resistance of the respective parallel connected diode 22, 23, 29, 30 of course is substantially less than the resistance of the spark gap so that any energy which might reach a spark plug due to malfunction, such as alloying-through or partial short circuit of a serially connected diode 18, 19, 25, 26, can be bypassed around the respective spark plug. If desired, a protective or dissipating resistor may be connected serially with the parallel diodes 22, 23, 29, 30 of just enough resistance to protect the respective diode, but still low enough so that the shunt path around the spark gap of the respective spark plug has a resistance substantially lower than the breakdown resistance of the respective parallel connected spark plug. Thus, damage to and misfire of the engine is readily prevented.

For use with an automotive-type four-cylinder engine, suitable diodes for series connection, that is, diodes 18, 19, 25, 26, are:

Diodes SMFR 30K of SEMTECH LIMITED, GLENROTHES, Scotland (GB).

Suitable diodes, in accordance with the present invention and to prevent misfire of the engine, that is, diodes 22, 23, 29, 30, are:

Diodes SMFR 30K of SEMTECH LIMITED, GLENROTHES, Scotland (GB).

What is claimed is:

1. In combination with a multi-cylinder internal combustion engine (ICE), an ignition system having an ignition coil (10) including a primary winding (6, 7) and a secondary winding (9);

means (12,14) connected to the primary winding and selectively energizing the ignition coil and, upon interruption of energization, providing spark pulse outputs at secondary terminals (17, 24) of a secondary winding of a polarity which depends on energization of a respective one of the primary windings (6,7);

at least two spark plugs (20, 21, 27, 28) connected to the respective secondary terminals (17, 24) of the secondary winding;

and reversely polarized diodes (18, 19; 25, 26) connected in series between the spark plugs and the respective secondary terminals of the secondary winding, and comprising, in accordance with the invention, means for preventing misfire of the engine by suppression of undesired firing or spark discharge of a spark plug upon malfunction of at least one of said serially connected diodes (18, 19; 25, 26) by passage of energy by a malfunctioning serially connected diode including an additional diode (22, 23; 29, 30) connected in parallel across each of the spark plugs (20, 21; 27, 28) to thereby short-circuit current through the additional diode upon passage of energy by the malfunctioning serially connected diode in reverse direction of its normal current flow due to malfunction, and thereby prevent misfire of the engine.

2. System according to claim 1, wherein the parallel connected diodes are high-voltage diodes.

* * * * *